US008043128B2

(12) United States Patent
Ando et al.

(10) Patent No.: US 8,043,128 B2
(45) Date of Patent: Oct. 25, 2011

(54) DETACHABLE CONNECTOR

(75) Inventors: Hironobu Ando, Tokyo (JP); Yasuhiro Enami, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/778,447

(22) Filed: May 12, 2010

(65) Prior Publication Data

US 2010/0297892 A1 Nov. 25, 2010

(30) Foreign Application Priority Data

May 19, 2009 (JP) ..... 2009-121046

(51) Int. Cl.
*H01R 13/514* (2006.01)

(52) U.S. Cl. ..... 439/752

(58) Field of Classification Search ..... 439/752, 439/862, 595–596, 701, 329
See application file for complete search history.

(56) References Cited

U.S. PATENT DOCUMENTS 4,715,025 A * 12/1987 Eijsermans ..... 720/601
5,250,920 A * 10/1993 Fujihisa et al. ..... 335/202
6,231,398 B1 * 5/2001 Furutani et al. ..... 439/701
6,589,082 B2 * 7/2003 Harasawa et al. ..... 439/752

FOREIGN PATENT DOCUMENTS

JP 2002-042965 A 2/2002
JP 2003-17187 1/2003

OTHER PUBLICATIONS

Office Action for Japanese Patent Application 2009-121046, Japan Patent Office, Apr. 18, 2011.

* cited by examiner

*Primary Examiner* — Jean F Duverne
(74) *Attorney, Agent, or Firm* — Kubotera & Associates LLC

(57) ABSTRACT

A connector includes a housing including a first housing unit and a second housing unit. The first housing unit is fitted to the second housing unit to form a fitting opening for receiving a plug connector. The first housing unit includes a rotatable section, and the second housing unit includes a support section for supporting the rotatable section to be rotatable to freely open the fitting opening. The support section is arranged to release the rotatable section so that the first housing unit is separated from the second housing unit when a force is applied to the support section.

6 Claims, 11 Drawing Sheets

DETACHABLE CONNECTOR

BACKGROUND TECHNOLOGY AND RELATED TECHNOLOGY

The present invention relates to a detachable connector. More specifically, the present invention relates to a connector having a housing, which has housing units that can be separated.

Patent Reference has disclosed an example of a conventional connector 104 of this type. FIGS. 20 through 22 show the conventional connector 104 disclosed in Patent Reference.

Patent Reference: Japanese Unexamined Patent Application Publication No. 2003-17187

The connector 104 mainly includes a base body 102 made of a resin, and a cover body 105 similarly made of a resin. FIG. 20 is a side view of the connector 104 which is in use; FIG. 21 is an enlarged top view of a connecting portion between the base body 102 and the cover body 105; and FIG. 22 is an enlarged view to illustratively show an operation of the connector 104 upon releasing a jointed portion.

The base body 102 and the cover body 105 are respectively used as a housing unit, and can be separated from each other. The base body 102 and the cover body 105 can be put together and thereby form a fitting opening (receiving surface) 123, into which a mating connector 100 connected to a cable 101 can be fitted. The base body 102 has protrusions 108 on its both side surfaces. When the protrusions 108 are elastically joined to holes 156 provided near each end of projecting arm section 155 of the cover body 105 from the outside, the base body 102 can rotatably support the cover body 105.

In the conventional connector with the configuration, especially by designing the projecting arm section 155 to be elastically deformable, even if an unexpected force is applied to the joint section between the base body 102 and the cover body 105, the hole 156 comes off from the protrusion 108 by elastically deforming the projecting arm section 155, and thereby damage of the connector can be prevented. The configuration for the separation may be improved by providing a slanted surface 182 on the protrusion 108, so that the hole 156 of the cover body 105 moves over the slanted surface 182.

However, in the conventional structure, the resistance against an unexpected force substantially depends only on a length of the projecting arm section 155 and the elasticity of the resin, so that possibility of damage still remains significant. Further, since the conventional structure exhibits twist resistance only in the lateral direction but hardly exhibits in the lower part, there still needs significant improvement.

The present invention is provided to solve the above-described problems in the conventional techniques. An object of the invention is to provide a connector that can effectively prevent a damage of a housing or a connector by improving the twist resistance in various directions, reinforcing the elastic action at the joint section; and intentionally separating the housing upon receiving excess force.

Further objects and advantages of the invention will be apparent from the following description of the invention.

SUMMARY OF THE INVENTION

According to an aspect of the invention, a connector has a housing, which includes housing units that can be separated from each other. A first housing unit and a second housing unit can form a fitting opening to fit a plug connector therein by putting the housing units together. The first housing unit has a rotatable section and the second housing unit has a support section to support the rotatable section when the first housing unit and the second housing unit are put together. By freely rotatably supporting the rotatable section with the support section, it is possible to freely open/close the fitting opening, and if a force is applied onto the support section, the support to the rotatable section from the support section is released and thereby the first housing unit and the second housing unit are separated.

In the connector, the rotational section may be a pivot shaft, and the support section may include a catching section, to which the pivot shaft hits when the first housing unit and the second housing unit are put together, and a bearing section, which is energized towards the catching section on the side facing the catching section. By using the catching section and the bearing section so as to freely rotatably support the pivot shaft therebetween, the fitting opening may be freely opened and closed. If a force is applied onto the pivot shaft in a direction to move away from the catching section, the first housing unit and the second housing unit can move away from each other, moving the bearing section from the catching section with the pivot shaft against the elastic action of the bearing section, and releasing the support of the pivot shaft by the bearing section.

In the above connector, the bearing section may be formed by an end of a U-shaped metal spring, which has the other end secured onto the second housing unit.

In the above connector, the force in the separating direction may be dispersed by contacting a part of the first housing unit to a part of the second housing unit on the remote side from the fitting opening than the pivot shaft.

Further, in the above connector, the part of the second housing unit may have a protrusion that protrudes to the first housing side, and the part of the first housing unit may have an insertion hole, to which the protrusion can be inserted, so that the protrusion can enter the insertion hole upon contacting the part of the second housing unit to the part of the first housing unit.

Moreover, in the above-described connector, the shape of a cross-section of the pivot shaft may be oval.

In addition, it is possible to adjust the size of the fitting hole by engaging an engaging section of the second housing unit to a corresponding section of the first housing unit on the side closer to the fitting opening than the rotatable section.

For example, in case of receiving excess force, the housing units may be separated so as to effectively prevent a damage of the connector. Here, the separated housing units may return to the specific positions by elastic action.

DETAILED DESCRIPTION OF THE PREFERRED EMBODIMENTS

Figure 1:
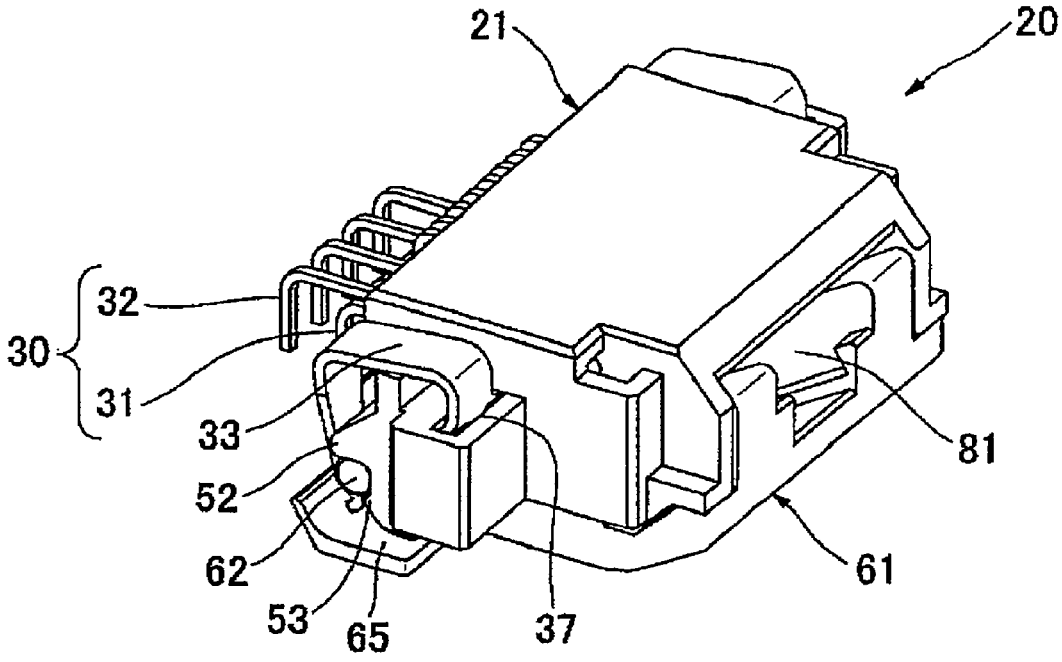
FIG. 1 is an upper perspective view of a connector of the invention, where a fitting opening is in a closed state.

Hereunder, embodiments of the invention will be fully described based on the accompanying drawings. Here, in the drawings showing the embodiments of the invention, basically, the same reference numerals are used for the same members and repetitive explanation is omitted.

Referring now to the accompanying drawings, a connector according to one preferred embodiment of the invention will be described. The connector may be used, for example, as a telephone modular on the plug receiving side.

Figure 2:
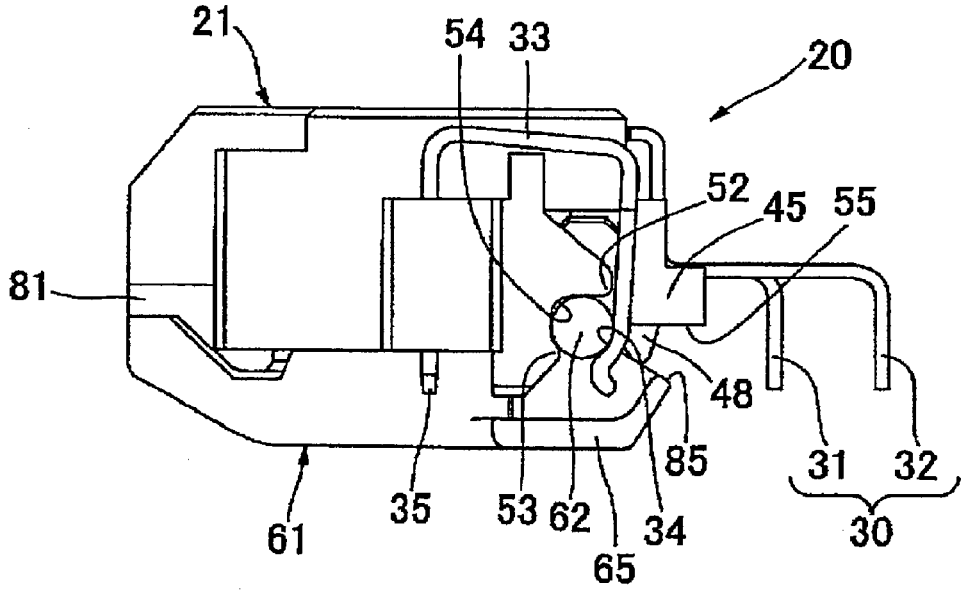
FIG. 2 is a side view of the connector, where a fitting hole is in a closed state.
Figure 3:
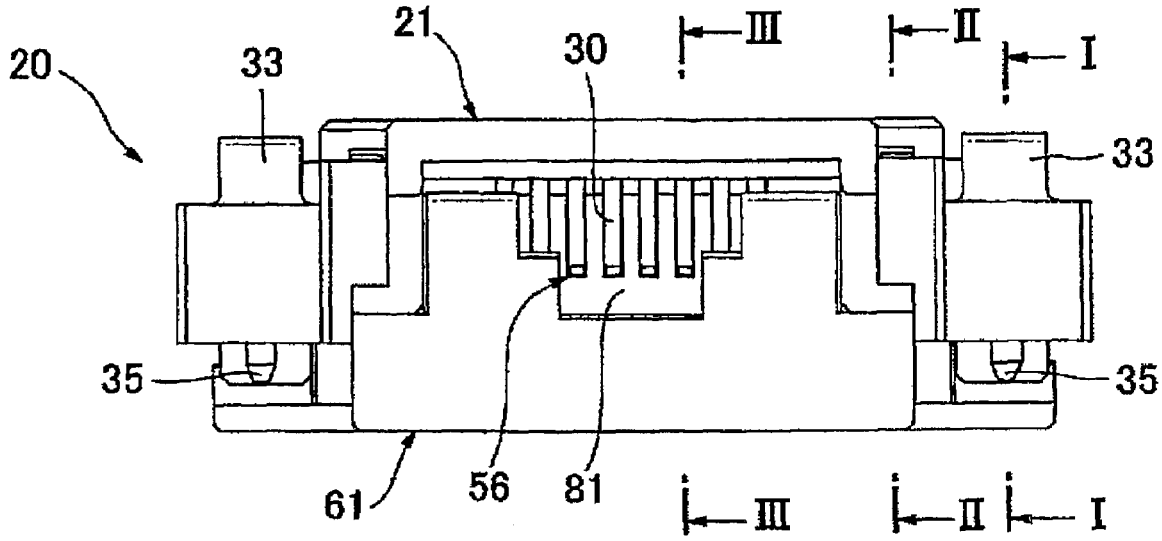
FIG. 3 is a front view of the connector, where the fitting opening is in the closed state.
Figure 4:
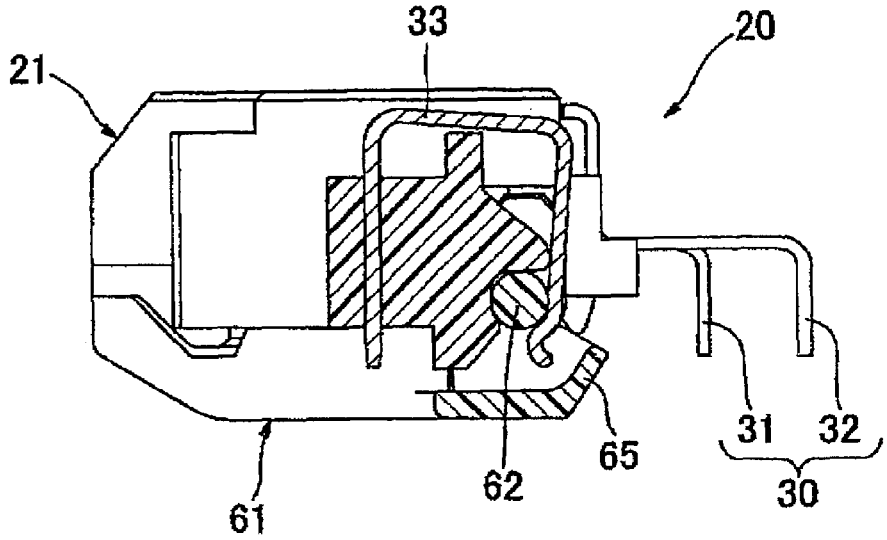
FIG. 4 is a sectional view of FIG. 3 taken along a line I-I.
Figure 5:
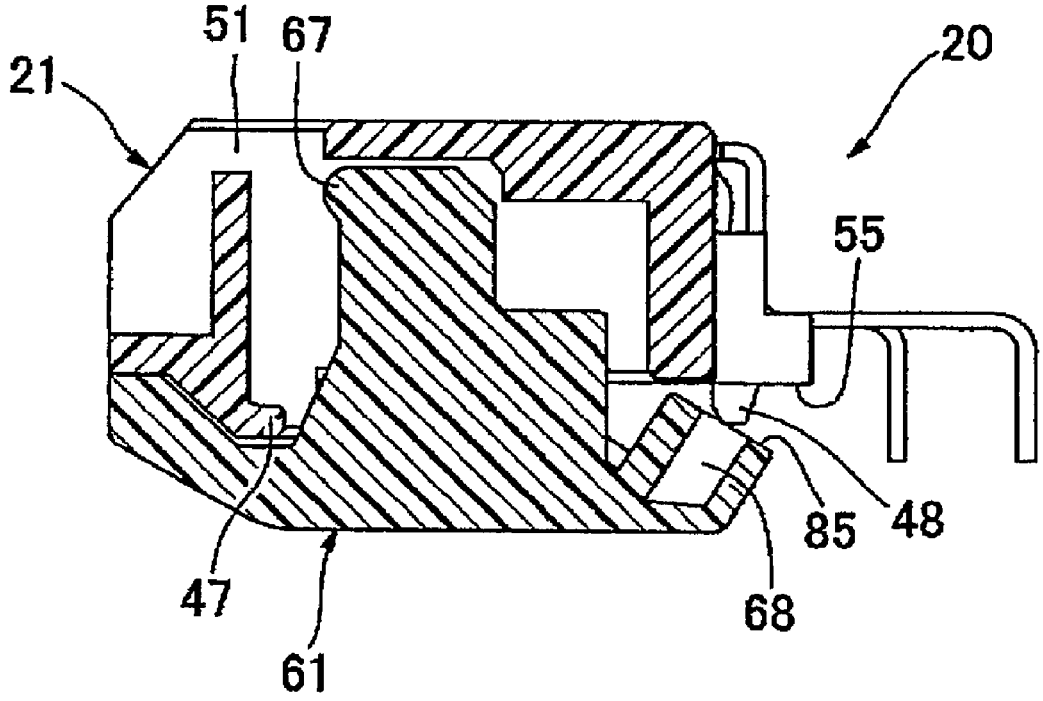
FIG. 5 is a sectional view of FIG. 5 taken along a line II-II.
Figure 6:
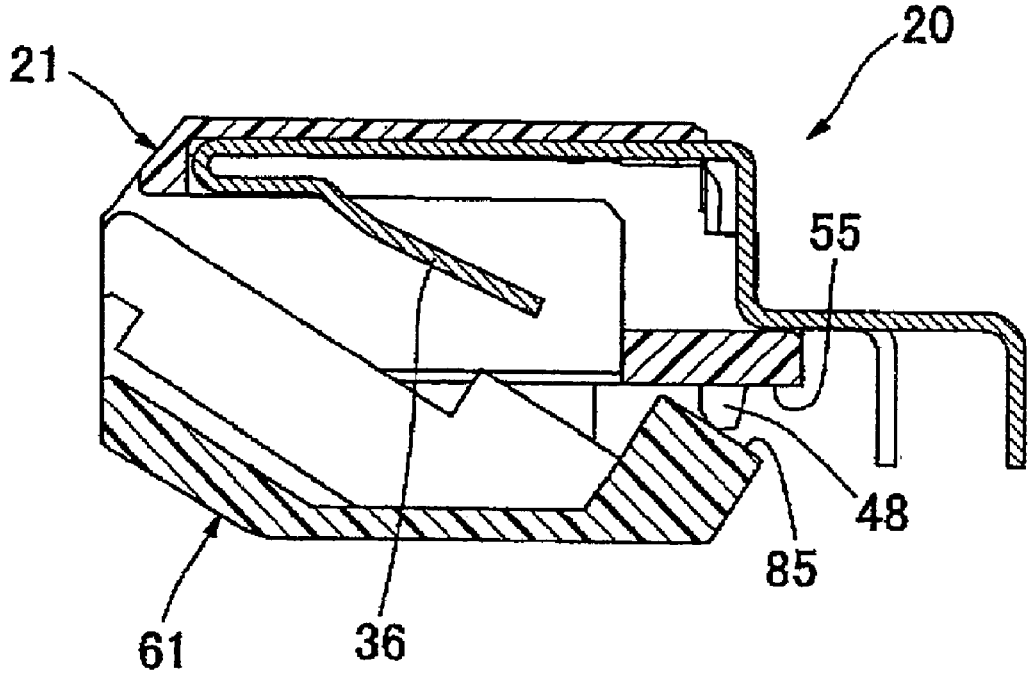
FIG. 6 is a sectional view of FIG. 5 taken along a line III-III.
Figure 7:
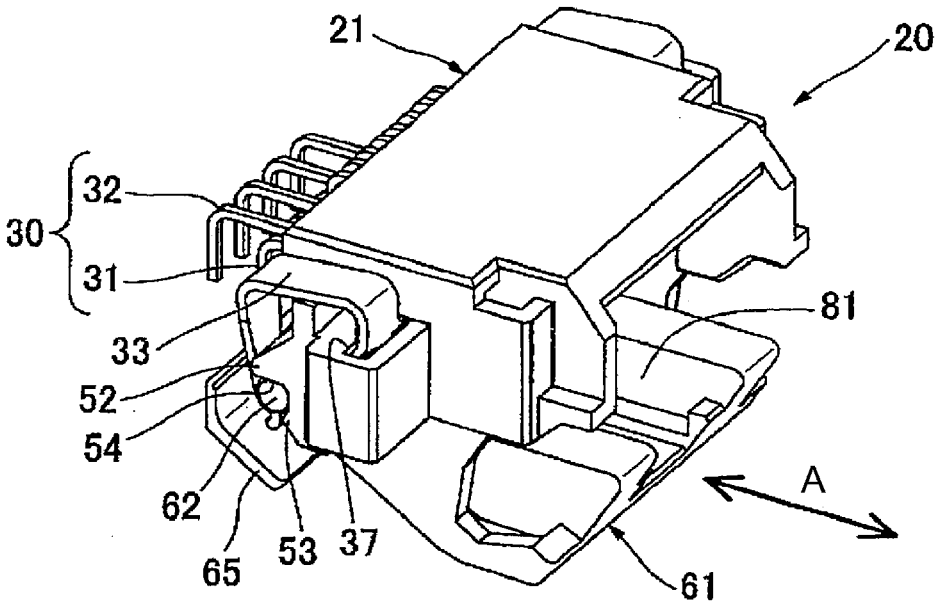
FIG. 7 is an upper perspective view of the connector, where the fitting opening is in an open state.
Figure 8:
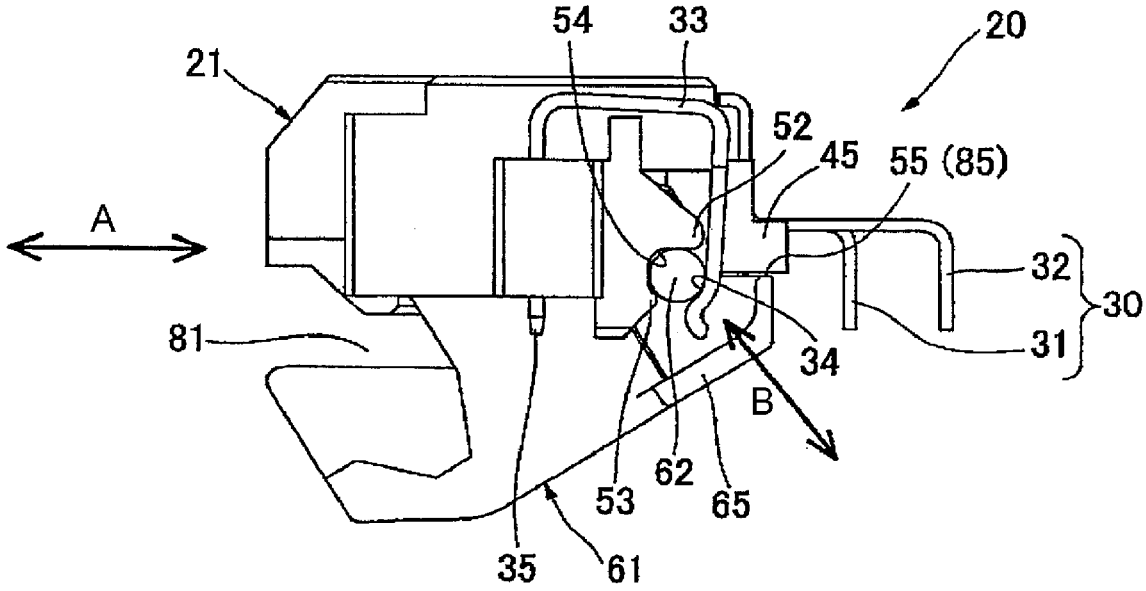
FIG. 8 is a side view of the connector, where the fitting opening is in the open state.
Figure 9:
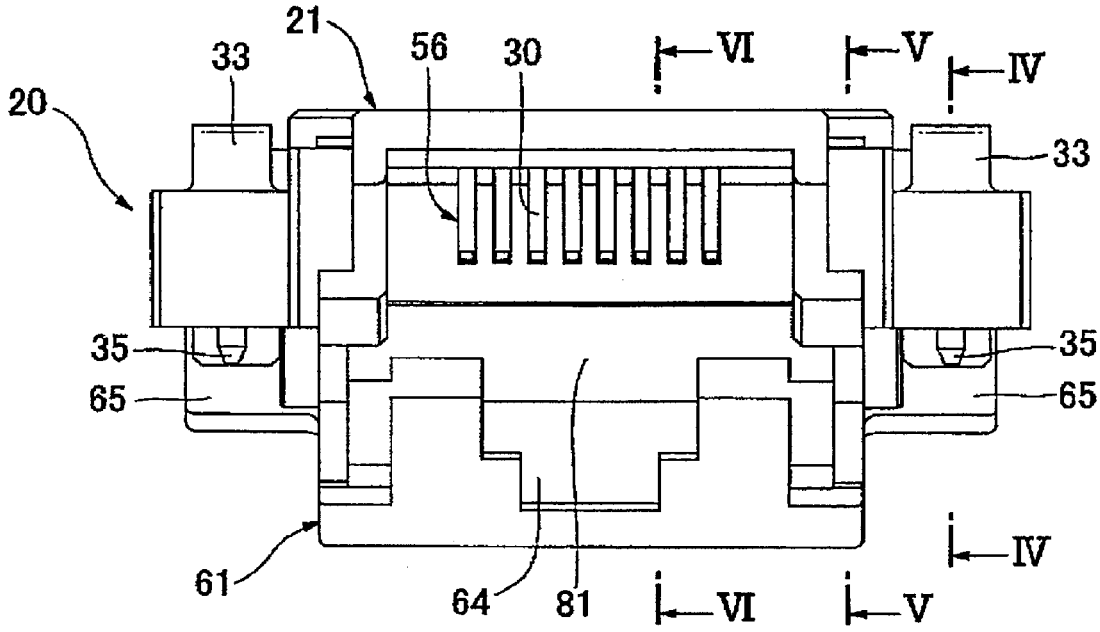
FIG. 9 is a front view of the connector, where the fitting opening is in the open state.

FIGS. 1 through 3 show an upper perspective view, a side view, and a front view of a connector 20, respectively, where a fitting opening 81 is in a closed state. FIGS. 4 through 6 are sectional views of FIG. 3 taken along lines I-I, II-II, and III-III, respectively. FIGS. 7 through 9 are an upper perspective view, side view, and front view of the connector 20 respectively, where the fitting opening 81 is in an open state.

Figure 10:
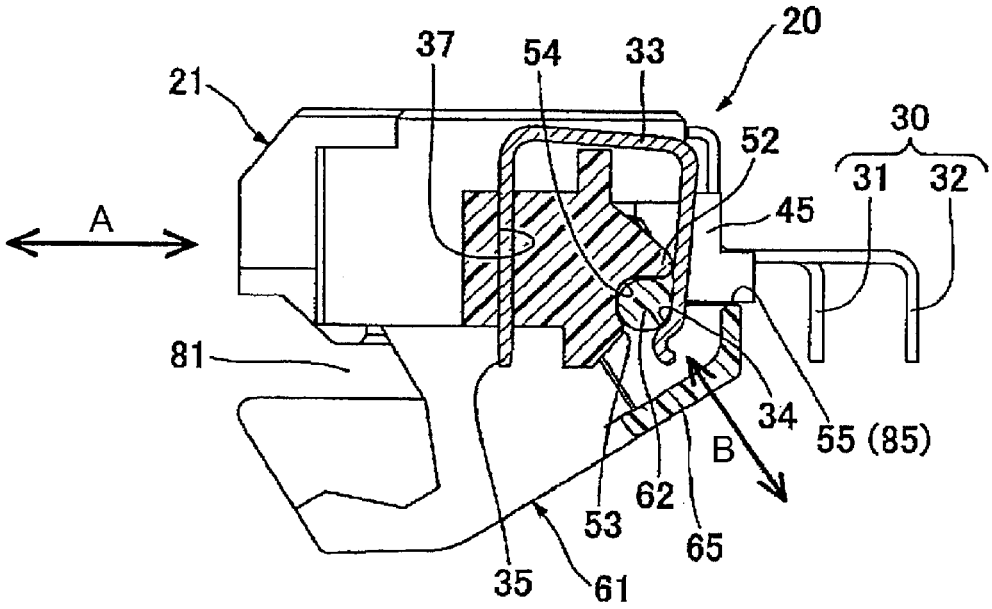
FIG. 10 is a sectional view of FIG. 9 taken along line IV-IV.
Figure 11:
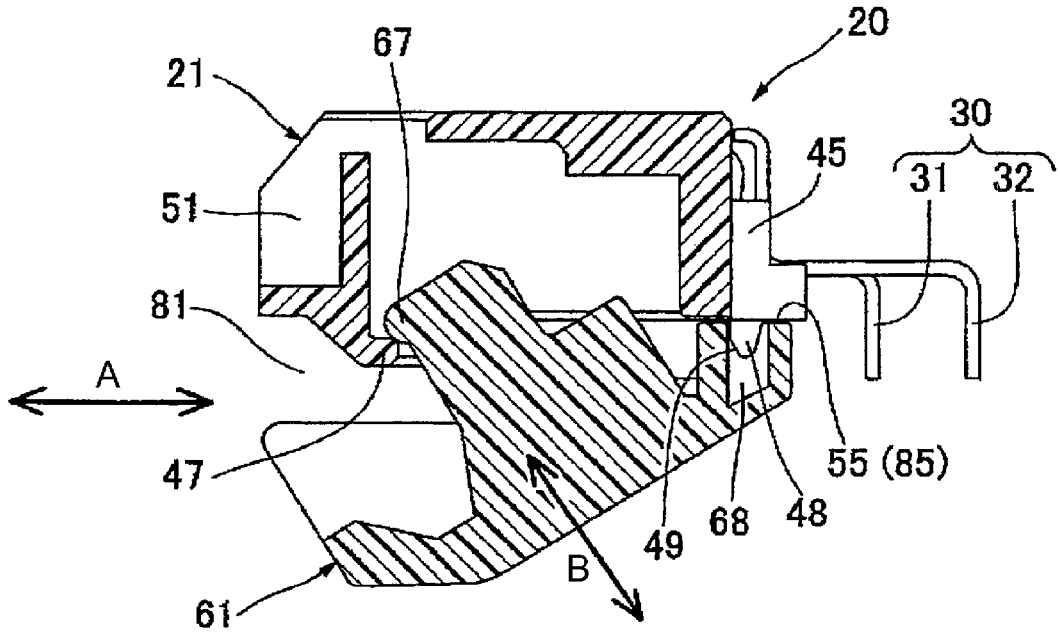
FIG. 11 is a sectional view of FIG. 9 taken along line V-V.
Figure 12:
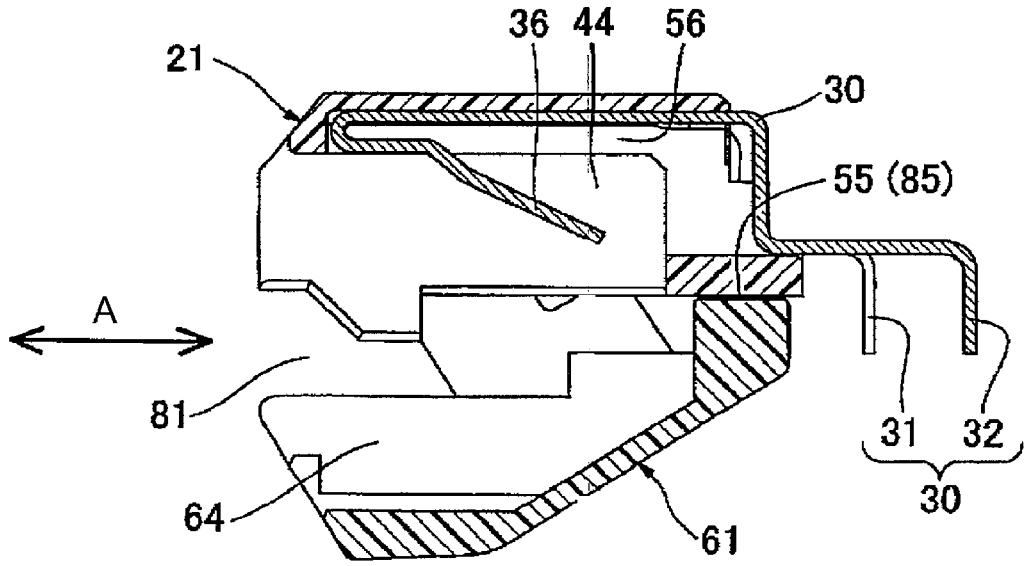
FIG. 12 is a sectional view of FIG. 9 taken along line VI-VI.
Figure 13:
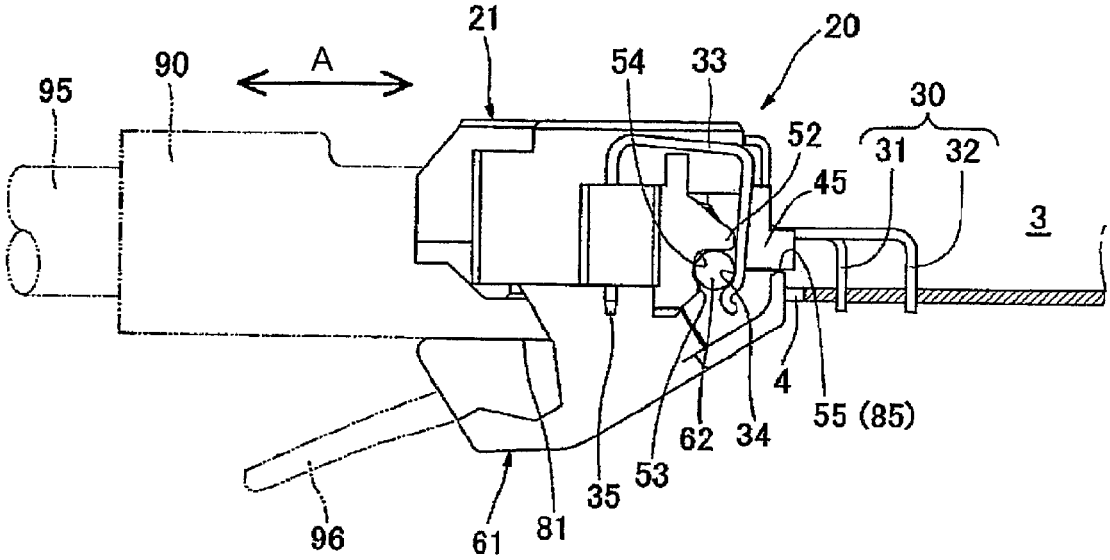
FIG. 13 shows an example of use of the connector.
Figure 14:
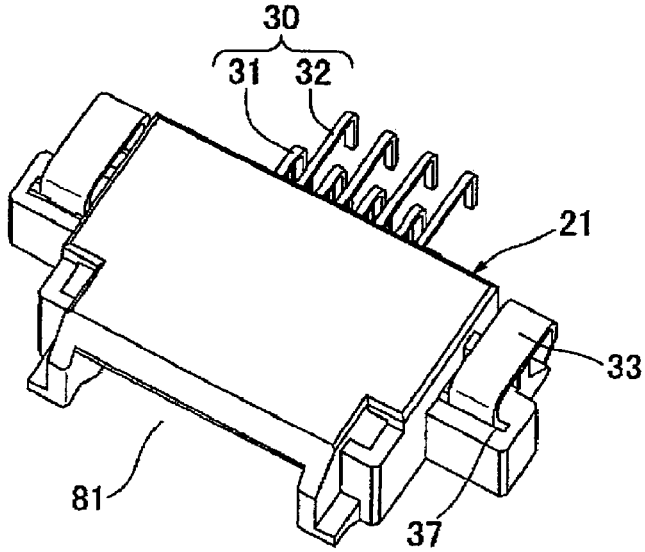
FIG. 14 is an upper perspective view of a stationary housing unit, in which a signal terminal and a metal spring are secured.
Figure 15:
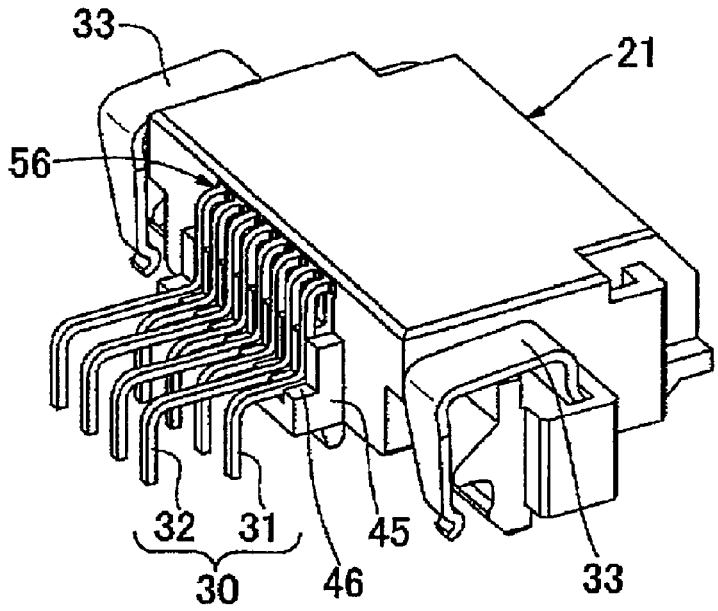
FIG. 15 is a backside perspective view of a stationary housing unit, in which a signal terminal and a metal spring are secured.
Figure 16:
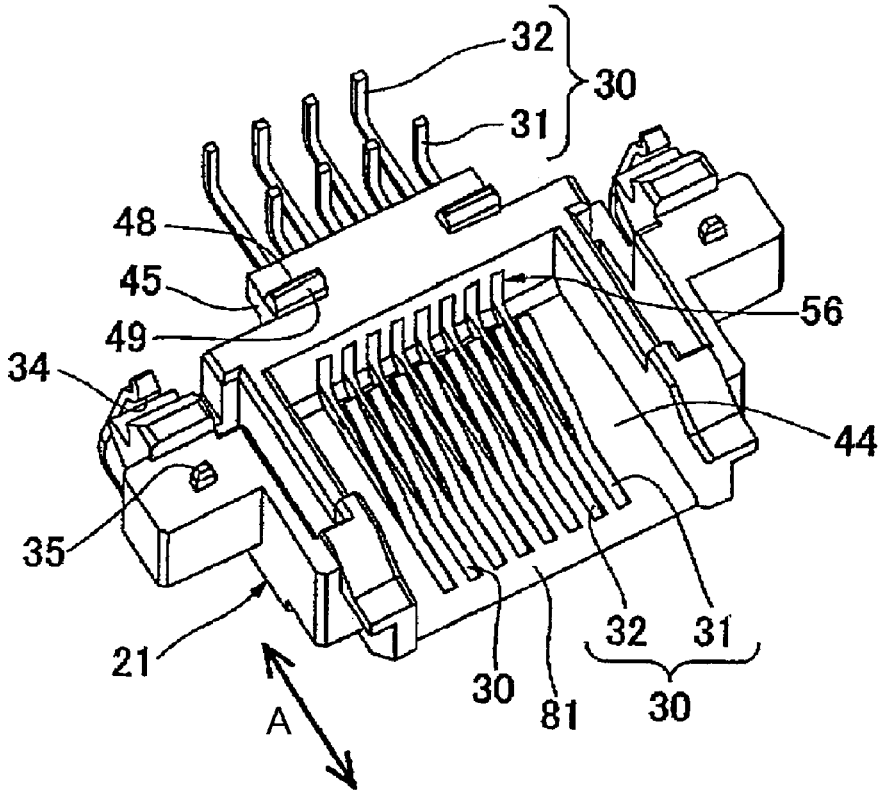
FIG. 16 is a perspective view showing inside of a stationary housing unit, in which a signal terminal and a metal spring are secured.
Figure 17:
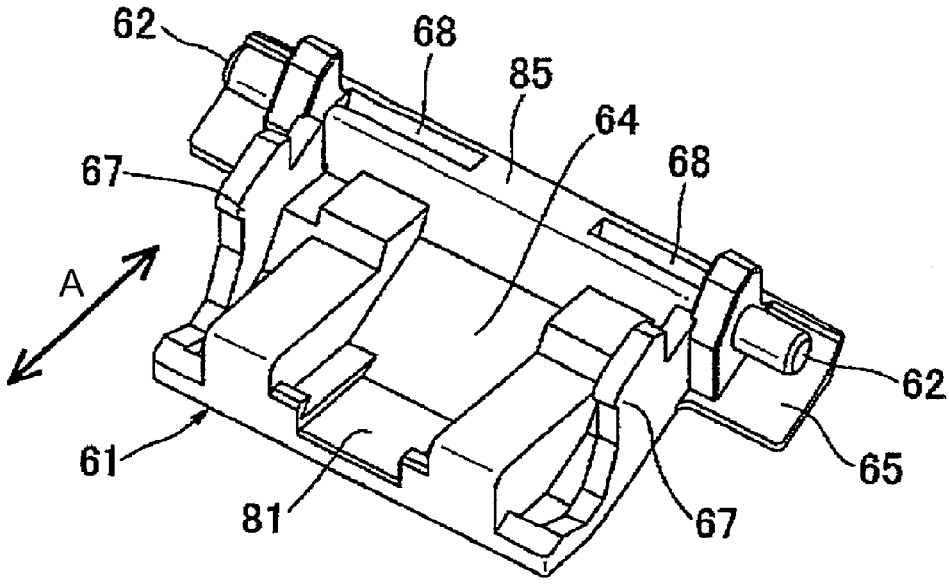
FIG. 17 is a perspective view showing inside of the movable housing unit.

FIGS. 10 through 12 are sectional views of FIG. 9 taken along lines IV-IV, V-V, and VI-VI, respectively. FIG. 13 shows an example of actual use of the connector 20, correspondingly to FIGS. 2 and 8. FIGS. 14 through 16 are an upper, backside, and inner perspective views of the stationary housing unit 21 respectively, to which signal terminals 30 and metal springs 33 are secured. FIG. 17 is an inner perspective view of a movable housing unit 61.

As shown in those figures, the connector 20 has a housing, which includes a stationary housing unit 21 and a movable housing unit 61, which can be separated from each other; a signal terminal 30 and a U-shaped metal spring 33, which are secured to the stationary housing unit 21. With the stationary and the movable housing units 21 and 61, which can be separated from each other, the fitting opening 81 can be freely opened/closed and a low profile connector is achieved.

Putting the stationary housing unit 21 and the movable housing unit 61 together, the fitting opening 81 can be formed. As shown in FIG. 13, for example, it is possible to fit a plug connector 90 connected to an end of a cable 95 into the fitting opening 81, which is in the open state, from a specific direction (direction indicated with an arrow "A" in FIG. 13, etc.). At this time, it may be possible to lock the plug connector 90 to the receptacle connector 20 using a tab 96 provided on the plug connector 90. The configuration of the plug connector 90 like this may be the same as a conventional one and detailed description will be omitted.

Next, referring to FIG. 13, the receptacle connector 20 may be secured on a substrate 2 for example, which is disposed inside a casing 3 of an electric device. In order to secure the receptacle connector 20, each signal terminal 30 and a rear end section 35 of each metal spring 33 in the stationary housing unit 21 are soldered to specific positions on the substrate 2. Here, only the stationary housing unit 21 is secured, and the movable housing unit 61 would not be secured. Without securing onto the substrate 2, the movable housing unit 61 is provided while being in a state to be able to protrude outward from the casing 3 through a cutout section 4 provided on the substrate 2 and in a state to be able to separate from, re-attach to, or pivot around the stationary housing unit 21. When the fitting opening 81 is in the open state, the movable housing unit 61 significantly protrudes outside the casing 3. On the other hand, when the fitting opening 81 is in the closed state, generally entire movable housing unit 61 is housed inside the casing 3. Accordingly, the movable housing unit 61 is housed in the casing 3 when it is not used, and the movable housing unit 61 can be taken out from the casing 3 only upon use, so as to achieve size reduction of an electronic device.

By having the stationary housing unit 21 and the movable housing unit 61 to be detachable and re-attachable to/from each other, there is an advantage of using the same color for the resin color of the movable housing unit 61 as the resin color of the electronic device casing 3, in addition to an advantage of being able to prevent damage of the housing and the connector in advance. In case of a reflow-packaged product of an interface connector, since only a heat resistant pigment can be used, it is difficult to use the same color for the casing 3. However, if the movable housing unit 61 and the stationary housing unit 21 are designed to be detachable and the manufacturing step is coordinated to incorporate them after reflow, the same resin color may be used for the movable housing unit 61 as that of the casing 3. As can be easily understood, according to this configuration, a non-heat resistant pigment may be also used onto the resin of the movable housing unit 61.

As well illustrated in FIG. 12, the stationary housing unit 21 and the movable housing unit 61 respectively form general half portion of a housing of the receptacle connector 20. Inside the stationary housing unit 21 and the stationary housing unit 61 are respectively formed to be depressed, and using those depressions 44 and 64, it is possible to form one fitting space for fitting the plug connector 90.

In the depression 44 of the stationary housing unit 21, signal terminal arrangement sections 56 are formed along the fitting direction "A" of the plug connector 90. Along those arrangement sections 56, a plurality of signal terminals 30 are disposed. The signal terminals 30 include the ones having short terminal length 31 and the ones having long terminal length 32. Those two types of signal terminals 31 and 32 are disposed alternately 4 of each type in a row, while forming contact sections 36 at the end side (FIGS. 6 and 12).

On each of left and right side surfaces of the depression 64 of the movable housing unit 61, a pivot shaft 62 is provided extending on the side of the movable housing unit 61. Furthermore, a cover may be provided to shield the pivot shaft 62 from the outside. With the cover 65, it is possible to prevent dust intrusion to the pivot shaft 62, etc., and also possible to cover so as to prevent undesired operation. Moreover, a bumping section 85 is provided so as to be able to bump to a part 55 of the stationary housing 21, being adjacent to the pivot shaft 62, i.e. on the side that is remote from the fitting opening 81 than the pivot shaft 62. This bumping section 85 may further have an insertion hole 68. The actions of the bumping section 85 and the insertion hole 68 will be described in a later part of this specification.

The stationary housing unit 21 has a depressed catching section 54, which bumps to the pivot shaft 62 upon attachment to the movable housing unit 61. On the side facing the catching section 54, which is on the side remote from the fitting opening 81, a bearing section 34 is provided to support the side facing the pivot shaft 62. Using a supporting section formed by the catching section 54 and the bearing section 34 and thereby freely rotatably supporting the pivot shaft 62 therebetween, it is possible to freely open/close the fitting opening 81. Here, in order to ensure the supporting of the pivot shaft 62 by the catching section 54 and the bearing section 34, the catching section 54 may have an upper projecting section 52 that extends from a part of the catching section 54 along the fitting direction "A", and has a lower projecting section 53 that extends from a part of the catching section 54 downward.

The bearing section 34 may be formed, for example, using a U-shaped metal spring 33. One end of the U-shaped metal spring 33 may be secured by pressing into a press-in hole 37 of the stationary housing unit 21, and the other end can form a bearing section 34 on the other side of the catching section 54. By forming a protruding bent section on the end side of the bearing section 34 and setting the distance between the catching section 54 and the lower projecting section 53 shorter than the diameter of the diameter of the pivot shaft 62, the metal spring 33 is prevented from coming off from the stationary housing unit 21. In addition, by employing a U-shape, the metal spring 33 is effectively prevented from coming off from the stationary housing unit 21, and by making from metal, it is possible to energize the bearing section 34 towards the catching section 54 by an elastic action of the metal spring 33.

Upon insertion of the plug connector 90 in the fitting opening 81, we herein assume that force is applied to the movable housing unit 61 in a direction of separating the pivot shaft 62 from the catching section 54, i.e. in the direction "B" indicated in FIG. 8 and other figures, by twisting the plug connector 90. In this case, since the stationary housing unit 21 and the movable housing unit 61 can move away from each other and the bearing section 34 has an elastic action from the metal spring 33, the pivot shaft 62 moves away as designed from the catching section 54 with the bearing section 34 against the elastic action of the bearing section 34. As a result, without destroying the receptacle 20, it is possible to release the support of the pivot shaft 62 by the catching section 54 and the bearing section 34, so as to separate the movable housing unit 61 from the stationary housing 21. Here, a user may re-insert the detached movable housing 61 to the specific position by himself/herself using the elastic action of the metal spring 33, or even if it is damaged, it is possible to replace the damaged component by the user herself/himself.

Moreover, as for another advantage according to the configuration, while it is possible to exhibit sufficient durability in the direction indicated with "A" in FIG. 8 and other figures, i.e. in the pulling-out direction, it is possible to easily separate the movable housing unit 61 from the stationary housing unit 21 in the direction "B", i.e. in the detaching direction. More specifically, while it is possible to securely prevent displacement of the pivot shaft 62 by the catching section 54 in the direction "A" that is typically used for fitting the plug connector 90, the detachment of the pivot shaft 62 would not be distracted since the catching section 54 is on the side opposite to that for pulling out the pivot shaft 62 in the direction "B".

In order to stabilize the support of the pivot shaft 62 by the catching section 54 and the bearing section 34, a bumping section 55 that can contact to a part 85 of the movable housing 61 may be provided on a bottom face of a terminal arrangement base, i.e. on the side more remote from the fitting opening 81 than the pivot shaft 62. In case the pivot shaft 62 of the movable housing unit 61 receives force in the direction "B", i.e. in the detaching direction, from the catching section 54, the contact between the bumping sections 55 and 85 can disperse the force applied around the pivot shaft 62. In addition, upon receiving even larger force, the movable housing unit 61 may rotate in relative to the stationary housing unit 21 around the fulcrums, i.e. the bumping sections 55 and 85, so as to move the pivot shaft 62 away from the stationary housing unit 21, so as to safely and stably release the support of the pivot shaft 62 by the catching section 54 and the bearing section 34.

Corresponding to the insertion hole 68 provided on the bumping section 85, the bumping section 55 of the stationary housing unit 21 has a protruding section 48 that protrude to the movable housing unit 61 side. Upon contact between the bumping section 55 of the stationary housing unit 21 and the bumping section 85 of the movable housing unit 61, by inserting the protruding section 48 of the bumping section 55 into the insertion hole 68 of the movable housing unit 61 so as to function as a stopper, anti-twisting property can be reinforced in the fitting direction and the axial direction (left-right direction) of the pivot shaft 62. Here, the protruding section 48 may have a taper 49 on the fitting opening 81 side in order to suitably adjust the strength.

It may be possible to adjust the size of the fitting opening 81 also by adjusting the contacting position between the bumping section 55 of the stationary housing unit 21 and the bumping section 85 of the movable housing unit 61, but alternatively, it may be also possible to adjust by optionally adjusting the engaging position between the engaging section 47 of the stationary housing unit 21 and the corresponding engaging section 67 of the movable housing unit 61 around the fitting opening 81.

For example, as shown in FIGS. 5 and 11, when the fitting opening 81 in the open state, the engaging section 47 that can engage with the corresponding engaging section 67 of the movable housing unit 61 on the side closer to the fitting opening 81 may be provided on an outer wall 51 inside the stationary housing unit 21, and thereby it is possible to restrict the movable housing unit 61 from opening more than specified amount in relative to the stationary housing unit 21.

The intensity of the restriction may be adjusted in view of the latching degree between the engaging section 47 and the corresponding engaging section 67, more specifically, influence from the protruding degree of the engaging section 47 and the corresponding engaging section 67 in the direction indicated with the arrow "B" in FIG. 11 and other figures. In this way, the anti-twisting property may be improved by having a hooking section at a front part of the fitting opening 81. Here, although it is not specifically illustrated in the figures, the closed state of the fitting opening 81 may be achieved, for example, by providing a locking spring on one of the stationary housing unit 21 and the movable housing unit 61 and providing a receiving section on the other. In addition, if the stationary housing unit 21 and the movable housing unit 61 have a protrusion/recess on their side surfaces, it may be possible to achieve the locking.

Figure 18:
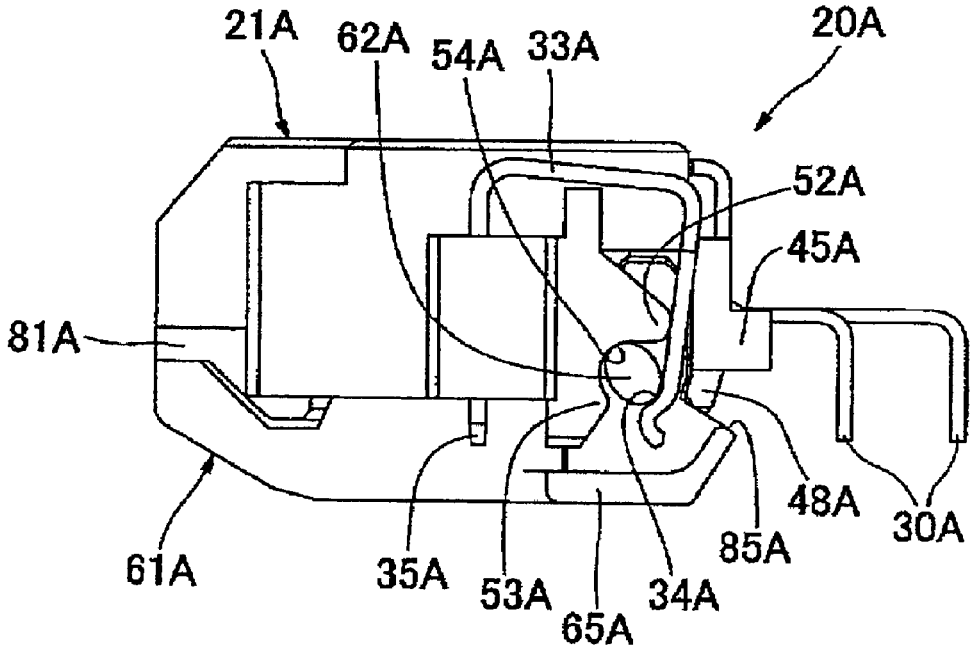
FIG. 18 is a modification example of the invention.
Figure 19:
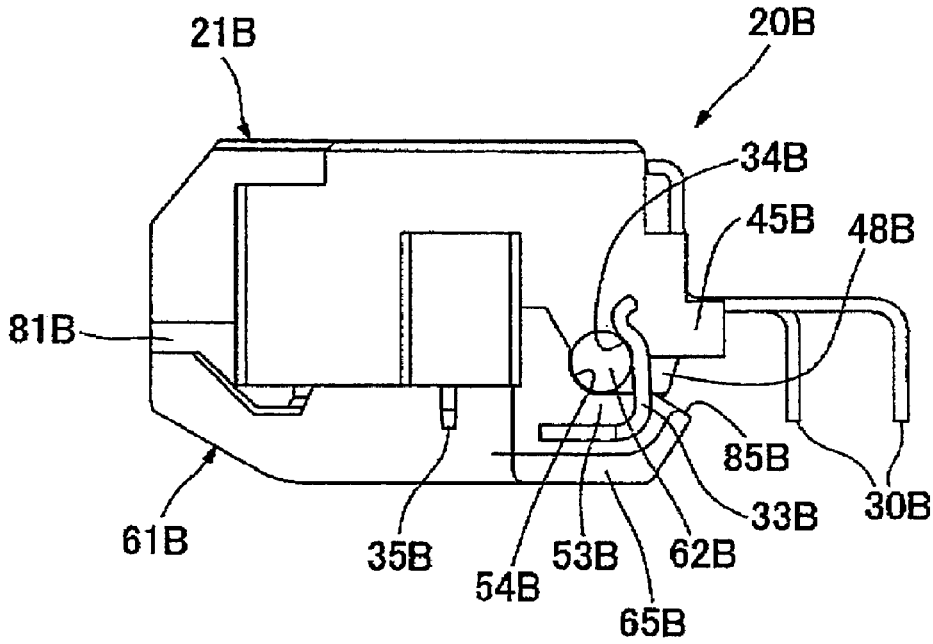
FIG. 19 is another modification example of the invention.
Figure 20:
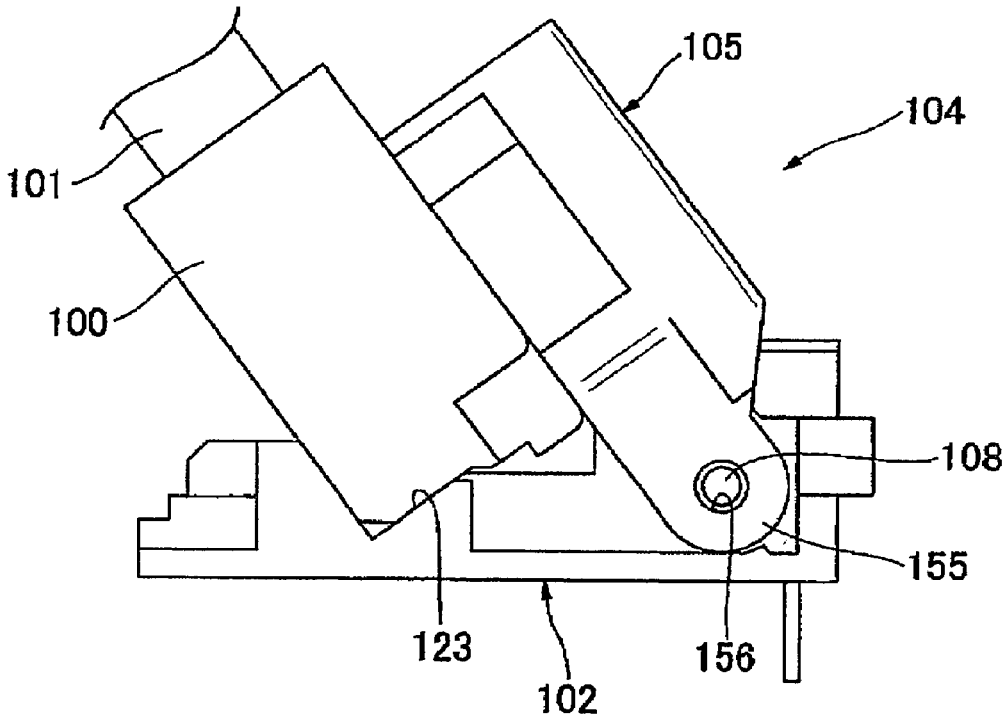
FIG. 20 PRIOR ART
FIG. 20 is a side view of a conventional connector in use.
Figure 21:
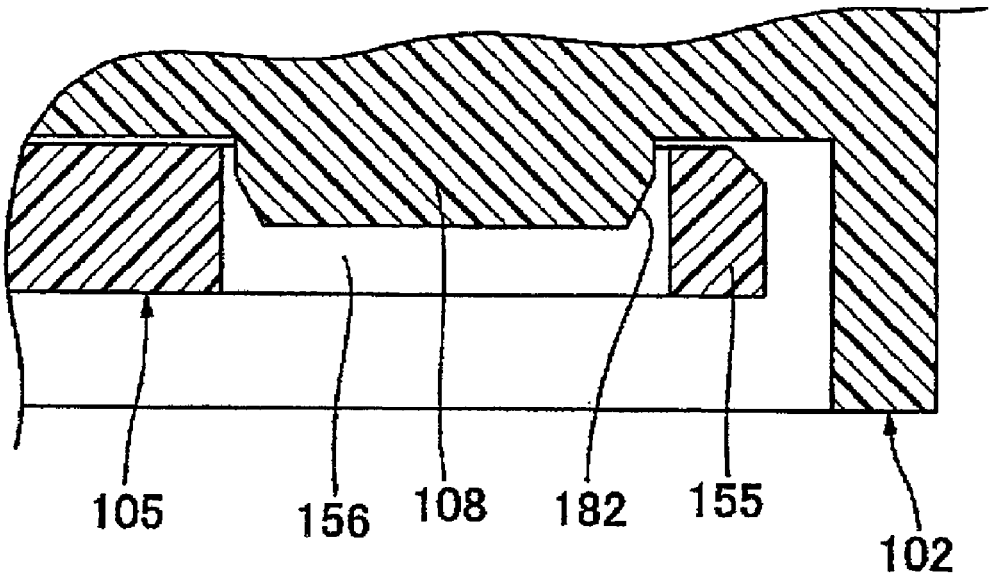
FIG. 21 PRIOR ART
FIG. 21 is an enlarged top view of a joint section between a base body and a cover body of the conventional connector.
Figure 22:
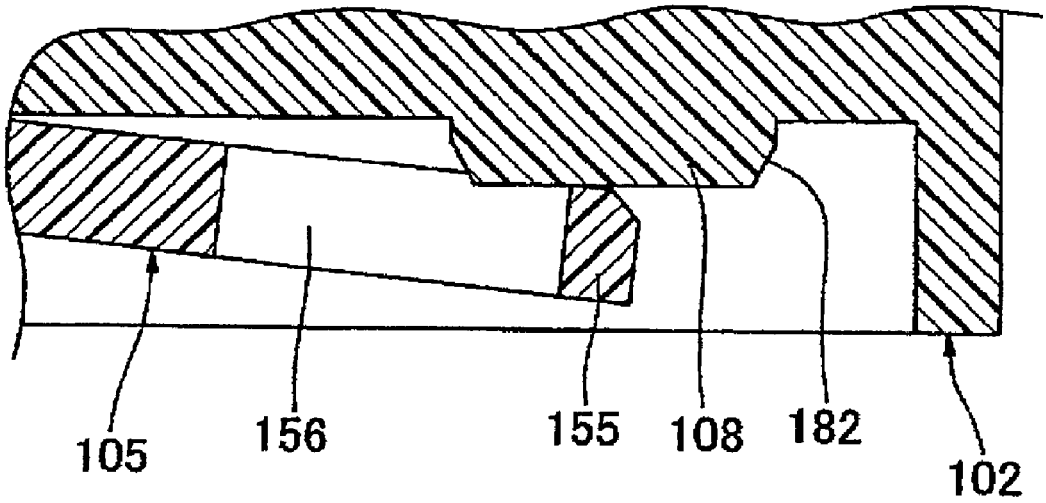
FIG. 22 PRIOR ART
FIG. 22 is an enlarged view to explain the action upon release of the joint section of the conventional connector.

FIGS. 18 and 19 are different modification examples of the invention. Those figures correspond to FIG. 2, which was already described above, and the same reference numerals are used for similar members to those in embodiments illustrated in FIG. 2 and other drawings for convenience. Furthermore, a letter "A" is affixed in FIG. 18, while a letter "B" is affixed in FIG. 19.

In the modification example of FIG. 18, side surface (cross-section) of the pivot shaft 62A has an oval shape. The shape may be polygonal or concave, but especially if it is an oval shape, by adjusting the curvature of the surface so as to also use an elastic action of the metal spring 33A, the closing force can be intensified. For example, when the movable housing 61A is in the closed state, by minimizing the diameter of the pivot shaft 62A, it is possible to keep the closed state.

On the other hand, when the plug connector is fitted by coordination with the aforementioned locking spring, if excess force is applied in a direction of separating from the stationary housing unit 21A on the movable housing unit 61A, it is possible to naturally apply force on the movable housing unit 61A in a direction opposite the separating direction, i.e. in a direction of closing the fitting opening 81A. With this configuration, it is possible to increase the closing force. Here, although not illustrated in the figures, but with regard to this modification example, for example, the bumping section (54) may not be a recess but may be generally semi-cylindrical protrusion, and correspondingly, a generally semi-circular recess may be provided, which can cover the generally semi-cylindrical protrusion instead of the pivot shaft (62) from the outside.

In the modification example of FIG. 19, being different from the embodiment illustrated in FIG. 2 or the like and the modification example shown in FIG. 18, the stationary housing unit 21B has the pivot shaft 62B and the movable housing unit 61B has the catching section 54B and the bearing section 34B (metal spring 33B).

In this structure, the physical relation in the height direction between the catching section 54B and the bearing section 34B (metal spring 33B) is opposite that in the example shown in FIG. 18 or the like, and the catching section 54B is provided on the lower side and the bearing section 34B is provided in the upper side, but their operations are similar to those in example shown in FIG. 18 or the like. Even with this configuration, with the actions of metal spring 33B etc., the stationary housing unit 21B and the movable housing unit 61B are separated from each other. The damages of the housing or connector can be effectively prevented.

The invention may be applied regardless of the type of a connector such as electrical connectors or optical connectors, and may be applied any connectors where damages of the connectors are issues.

The disclosure of Japanese Patent Application No. 2009-121046, filed on May 19, 2009 is incorporated in the application by reference.

While the invention has been explained with reference to the specific embodiments of the invention, the explanation is illustrative and the invention is limited only by the appended claims.

What is claimed is:

1. A connector, comprising:

a housing including a first housing unit and a second housing unit, said first housing unit being fitted to the second housing unit to form a fitting opening for receiving a plug connector, said first housing unit including a rotatable section, said second housing unit including a support section for supporting the rotatable section to be rotatable to freely open the fitting opening, said support section being arranged to release the rotatable section so that the first housing unit is separated from the second housing unit when a force is applied to the support section, wherein said rotatable section includes a pivot shaft, and said support section includes a catching section for abutting against the pivot shaft and a bearing section energized toward the catching section, said catching section and said bearing section being arranged to support the pivot shaft therebetween, said bearing section being arranged to move away from the catching section together with the pivot shaft to release the pivot shaft from the catching section and the bearing section so that the first housing unit is separated from the second housing unit when a force is applied to the pivot shaft in a direction to move away from the catching section.

2. The connector according to claim 1, wherein said bearing section is formed of a U-shaped metal spring having an end portion secured to the second housing unit.

3. The connector according to claim 1, wherein said first housing unit is arranged to contact with the second housing unit on a side away from the fitting opening farther than the pivot shaft so that the force in a separating direction is dispersed.

4. The connector according to claim 1, wherein said second housing unit includes a protrusion protruding toward the first housing unit, and said first housing unit includes an insertion hole for inserting the protrusion so that the protrusion enter the insertion hole when the second housing unit contacts with the first housing unit.

5. The connector according to claim 1, wherein said pivot shaft is formed to have a cross-section having an oval shape.

6. The connector according to claim 1, wherein said second housing unit includes an engaging section for engaging a corresponding section of the first housing unit on a side closer to the fitting opening than the rotatable section to adjust a size of the fitting hole.

* * * * *